United States Patent [19]

Gazda

[11] Patent Number: 4,844,160

[45] Date of Patent: Jul. 4, 1989

[54] PARKING MANDREL

[75] Inventor: Imre I. Gazda, Fort Worth, Tex.

[73] Assignee: Otis Engineering Corporation, Dallas, Tex.

[21] Appl. No.: 167,881

[22] Filed: Mar. 14, 1988

[51] Int. Cl.[4] ..... E21B 23/02

[52] U.S. Cl. ..... 166/217; 166/156; 166/382

[58] Field of Search ..... 166/123, 124, 120, 156, 166/181, 182, 207, 208, 217, 237, 240, 250, 382; 285/140, 141, 142, 143, 144

[56] References Cited

U.S. PATENT DOCUMENTS

| | | | |
|---|---|---|---|
| 3,727,693 | 4/1973 | Tausch et al. | 166/77 |
| 3,771,597 | 11/1973 | McGowen, Jr. | 166/77 |
| 4,398,601 | 8/1983 | Schwendemann et al. | 166/217 |
| 4,545,434 | 10/1985 | Higgins | 166/217 |
| 4,583,591 | 4/1986 | Krause, Jr. et al. | 166/217 |
| 4,583,592 | 4/1986 | Gazda et al. | 166/250 |
| 4,745,974 | 5/1988 | Higgins | 166/217 |

OTHER PUBLICATIONS

Otis, "Subsurface Flow Control Completion Equipment", 1985.

*Primary Examiner*—William P. Neuder
*Attorney, Agent, or Firm*—Roland O. Cox

[57] ABSTRACT

A well production system utilizing a submersible pump in which a parking mandrel is slidable around a flexible line and connected to the top of a string of test tools carried by the line. When the tools and mandrel are lowered into the well, the mandrel locks in a landing nipple in tubing below the pump. Pull on the line operates the mandrel and disconnects the tools to be lowered on the line through the mandrel to a deeper depth at which the well may be tested. The parking mandrel includes a pressure operated grease injector section. The well pump may be operated while testing the well increasing pressure sufficiently to operate the grease injector and seal the parking mandrel around the line. After well testing is completed, the line and tools are raised back to the parking mandrel and reconnected to the mandrel by pulling on the line. The parking mandrel may now be unlocked from the landing nipple for return to surface by lowering the line and then pulling the line again. The parking mandrel may be locked from the landing nipple at any time after locking in the nipple by pulling on the line.

18 Claims, 3 Drawing Sheets

PARKING MANDREL

FIELD OF THE INVENTION

The present invention relates to well tools and more particularly relates to a mandrel useful in well testing, which may be lowered into well tubing on flexible line to lock in a landing nipple with an internal shoulder and maybe operated while locked in the landing nipple by alternately pulling and lowering the line and later be unlocked from the landing nipple by again pulling on the line.

DESCRIPTION OF THE PRIOR ART

Examples of lock mandrels which lock in landing nipples having internal shoulders are disclosed in U.S. Pat. No. 4,545,434 to Brian D. Higgins, and U.S. patent application of Brian D. Higgins, Ser. No. 945,028 filed Dec. 22, 1986.

U.S. Pat. No. 4,583,592 to Imre I. Gazda and Phillip S. Sizer discloses a test tool mandrel which locks in a landing nipple, is operated while locked in the nipple by pulling and lowering the line attached to the mandrel and is then unlocked from the nipple by again pulling on the line.

It is well known in well production art to utilize an electrically powered submersible pump to produce a well. During the producing life of an electrically pumped well, it is often desirable to lower well testing instruments on flexible line into the well below the pump to determine and/or monitor conditions in or "test" the well. If the testing requires hours or days, it is very desirable to operate the well pump during this lengthy period to prevent loss of production from the well.

SUMMARY OF THE INVENTION

The parking mandrel of this invention may be lowered on flexible line into well tubing to land, seal and releasably lock or "park" in a landing nipple in the tubing. The landing nipple has an internal shoulder or no-go on which the parking mandrel lands and under which the mandrel locks. The line passes through the parking mandrel, which includes a pressure operated grease injector section for sealing around the line above a test tool string attached to the line. The parking mandrel is releasably connected to the top of the test tool string. After the mandrel parks in the landing nipple, tension is pulled on the line to disconnect the tool string from the mandrel. The line may now be lowered through the mandrel, lowering the tool string to any depth desired to test the well. The well pump now may be operated, increasing pressure around the mandrel sufficiently to operate the mandrel grease injector and seal the mandrel around solid or stranded line and prevent pumped fluids from being partially pumped back into the producing formation. When well testing is completed, the line is raised through the mandrel, lifting the tool string back to and reconnecting it to the mandrel by pulling tension on the line. Tension is again pulled on the line to unlock the parking mandrel from the landing nipple and lift the connected tool string and mandrel back to surface.

An object of this invention is to provide a parking mandrel having a through passage for line, which may be connected to a string of well tools attached to the line.

An object of this invention is to provide a parking mandrel which when lowered into a landing nipple having an internal shoulder will seal and automatically lock in the landing nipple.

Another object of this invention is to provide a parking mandrel which after locking in a landing nipple may be operated by pulling and lowering the line from surface to disconnect a tool string from and reconnect the tool string to the mandrel and unlock the parking mandrel from the landing nipple.

Another invention object is to provide a parking mandrel having closable flow passages providing inside pressure equal to outside pressure while lowering into a well.

Another object of this invention is to provide a parking mandrel having a pressure operated grease injector section for sealing around solid or stranded steel line.

Also an object of this invention is to provide a parking mandrel which may be unlocked at any time from a landing nipple by pulling on the line.

BEST MODE FOR CARRYING OUT THE INVENTION

Figure 1A:
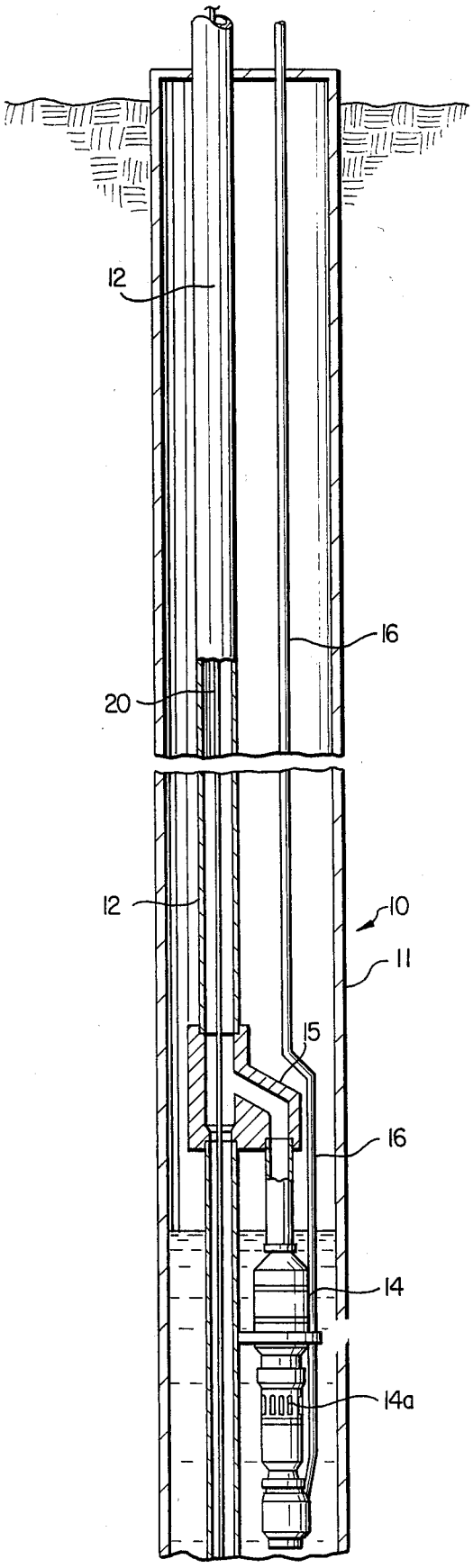
FIGS. 1A and 1B together is a schematic drawing showing a well system utilizing the parking mandrel of this invention.
Figure 1B:
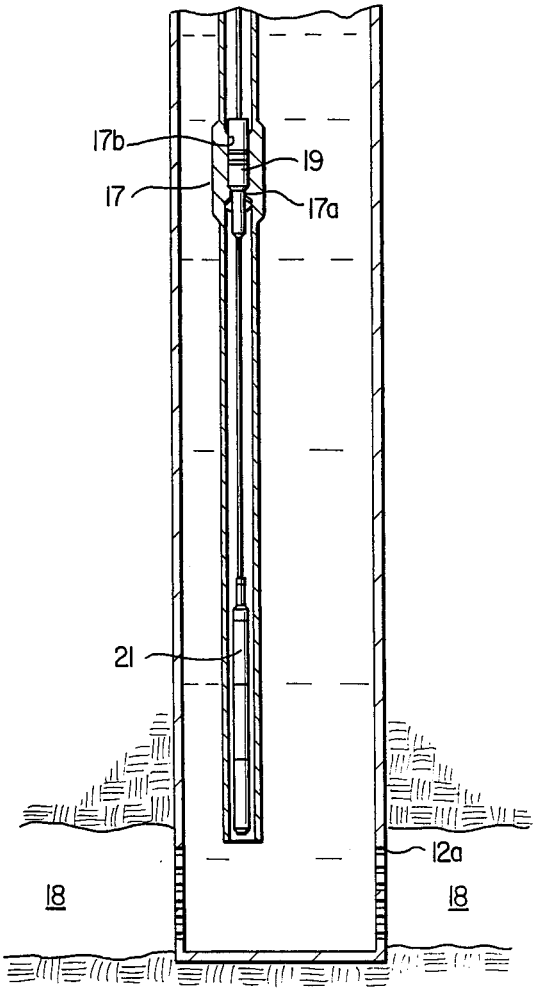

FIG. 1 shows a well 10 having a casing 11 in which there has been installed a tubing string 12. An electric pump 14 is connected into the tubing with a connector 15. A power supply line 16 from the surface conducts electrical power to the pump. There is a landing nipple 17 having an internal or no-go shoulder **17*a* with a seal bore above 17*b* in tubing string 12. No-go landing nipples compatible with the parking mandrel of this invention are shown on pages 116 and 117 of the "General Sales Catalog", a publication of Otis Engineering Corporation, P.O. Box 819052, Dallas, Tex. 75381. FIG. 1 also shows perforations 12*a* in the casing for admitting fluids to be pumped to the surface from a formation 18. The level of fluids admitted into the casing have risen above the intake openings 14*a* in pump 14. A Parking mandrel 19 of this invention has been lowered into the tubing on a line 20 to seal in bore 17*b*, land on the internal shoulder 17*a* and lock in the landing nipple. A string of test tools 21** carried on the flexible line have been lowered below the parking mandrel deeper into the well to test the well near the formation.

Figure 2A:
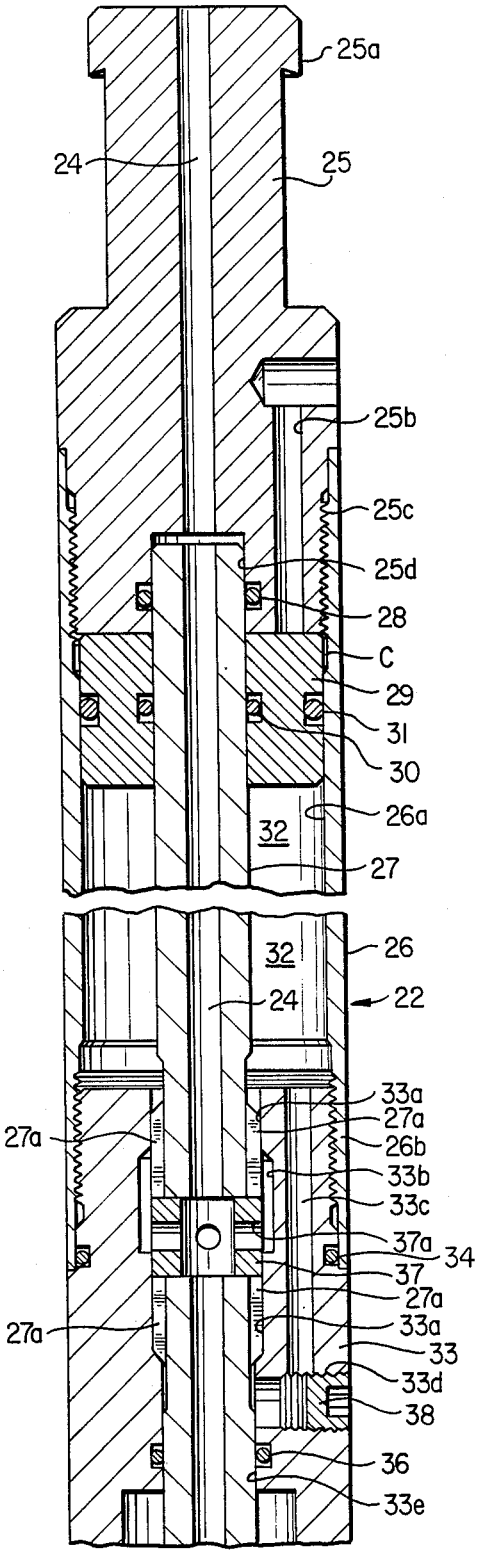
FIGS. 2A, 2B and 2C together is a sectioned drawing in elevation of the parking mandrel.
Figure 2B:
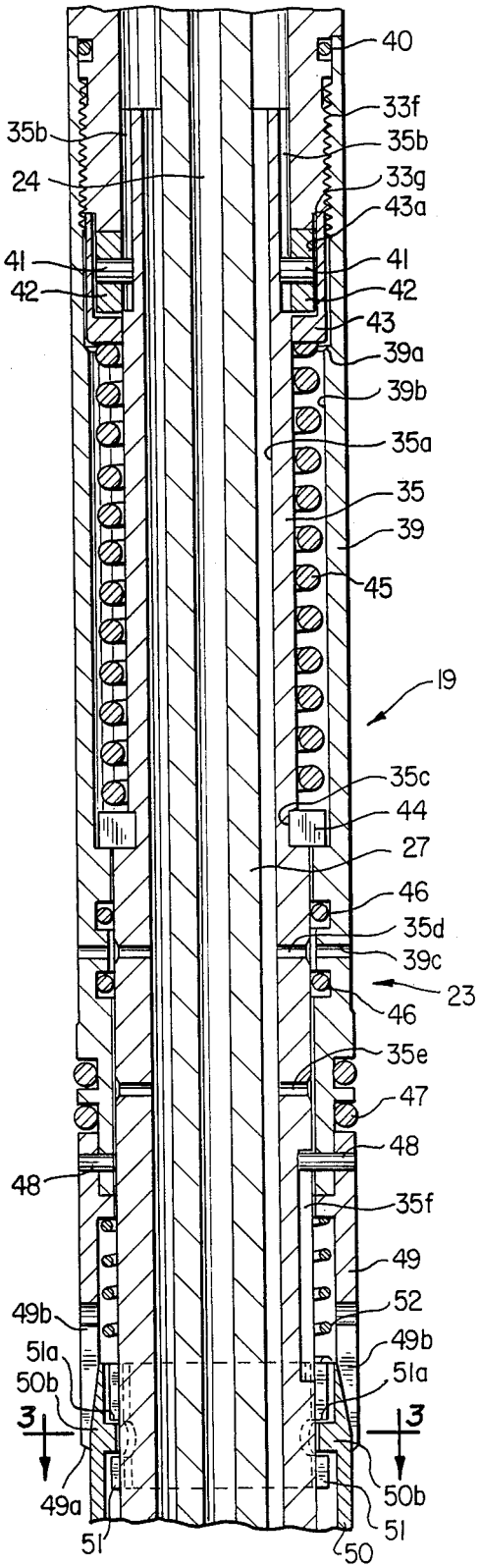
Figure 2C:
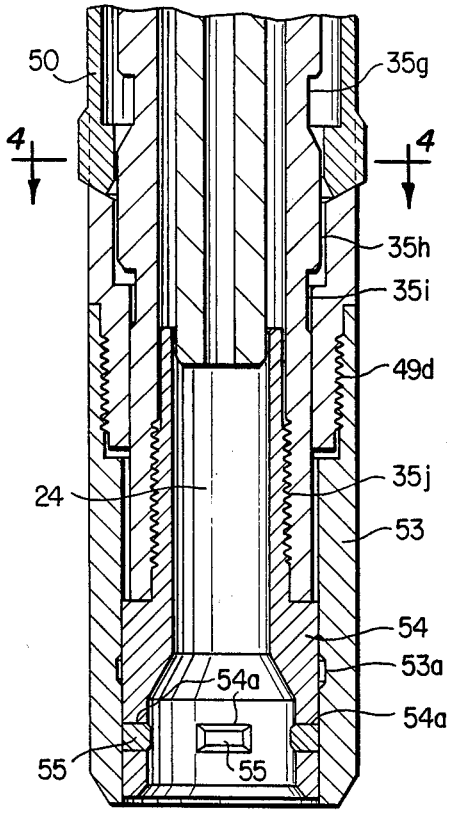

FIGS. 2A, 2B and 2C show the parking mandrel 19 which has an upper grease injector section 22, a lower locking and operating section 23 and a through passage for line 24.

The grease injector section has a top connector 25 having a fishing neck flange **25*a*, an inlet passage 25*b*, a thread 25*c* and a bore 25*d*. The connector is connected to injector housing 26 with thread 25*c*. Positioned in bore 25*d* is an upper tube 27 having at least one slot 27*a*** in its larger end. This tube is sealed in the bore with a resilient seal 28.

Slidably mounted around upper tube 27 in injector housing bore 26*a* is a piston 29, which is sealed around the tube with resilient seal 30 and sealed in the bore with resilient seal 31 to form a variable volume pressure chamber c with the housing and tube. An annulus 32 is formed between the upper tube and housing. The lower end of the injector housing has a thread 26b which connects the injector housing to a connector housing 33 and a resilient seal 34 seals between these housings. The injector housing has a bore 33*a*, a larger bore 33*b*, a flow passage 33*c*, a thread 33*d*, a bore 33*e* and another thread 33*f*.

The larger end of a lower tube 27 having at least one slat 27*a* is positioned in bore 33*a* and extends from bore 33*e* in the connector housing into a bore 35*a* in a reciprocable mandrel 35. This tube is sealed in the connector housing with resilient seal 36. Also positioned in bore 33*a* between upper and lower tubes 27 is a spacer 37 having at least one opening 37*a* opening into larger bore 33*b* and line passage 24. Annulus 32 may be filled with grease by removing plug 38 from thread 33*d* and pumping grease in through thread 33*d* and passage 33*c*. The grease is sealed in the annulus by installing a sealing plug 38 in thread 33*d*.

A lower mandrel housing 39 is connected to the connector housing with thread 33*f* and sealed to the connector housing with resilient seal 40. Mandrel 35 is reciprocable (longitudinally moveable) within housing 39 and locking and operating section 23 by pulling or lowering line 20 for operation of parking mandrel 19.

The level of the reciprocable mandrel 35 in the parking mandrel and operating section 23 is determined by which position pins 41 in rotatable ring 42 are in in the positioning grooves 35*b* on the mandrel. Ring 42 is free to rotate in a bore 43*a* in cup 43. The cup is retained in position between a shoulder 33*g* on the connector housing and a shoulder 39*a* in the lock mandrel housing.

Ring segments 44 are slidable in housing bore 39*b* and are retained in reciprocable mandrel groove 35*c* by bore 39*b*. Mounted around mandrel 35 between the cup and ring segments 44 is a spring 45, which biases the ring segments and mandrel downwardly and cup 43 upwardly.

Mandrel housing 39 has at least one wall flow passage 39*c*. Resilient seals 46 slidably seal the mandrel housing to the reciprocable mandrel 35 above and below passage 39*c*. Mandrel 35 has at least one wall flow passage 35*d* and at least one wall opening 35*e*. Resilient seals 47 for sealing the parking mandrel 19 in landing nipple bore 17*b* of FIG. 1 are in grooves around the parking mandrel housing.

Connected to the lower end of housing 39 with shear pins 48 is a lug housing 49. One of the shear pins extends into a slot 35*f* in the reciprocable mandrel to prevent the mandrel from rotating.

Figure 3:
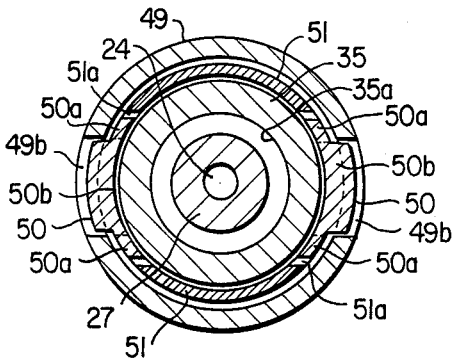
FIG. 3 is a cross section drawing along line 3—3 of FIG. 2.

The lug housing has a landing shoulder 49*a*, for landing on the internal shoulder 17*a* in landing nipple 17 and prevents parking mandrel 19 from going through and below the landing nipple. The lug housing has opposed wall openings 49*b* in which slidably mounted lugs 50 are retained by ears 50*a*. Each lug has a projection 50*b* which extends into an opening 51*a* in a sleeve segment 51 (See FIG. 3). A spring 52 around the reciprocable mandrel between a shoulder in the lug housing and the top of the sleeve segments biases the segments and the lugs downwardly.

Figure 4:
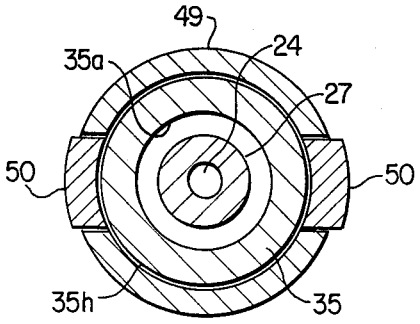
FIG. 4 is a cross section drawing along line 4—4 of FIG. 2.

Mandrel 35 has an expander surface 35*h* which when inside lugs 50 holds the lugs in expanded position as shown in FIG. 4. Mandrel 35 also has a groove 35*g* into which lugs 50 may retract on being moved upwardly off expander surface 35*h*. Connected to the lower end of lug housing 49 by thread 49*d* is a tool connector housing 53 having an internal groove 53*a*. Mandrel 35 has another groove 35*i* into which lugs 50 may retract when the mandrel is moved upwardly, relative to lug housing 49. Connected to the lower end of reciprocable mandrel 35 by thread 35*j* is a tool connector mandrel 54 having slots 54*a* in which are mounted laterally slidable lugs 55.

Figure 5:
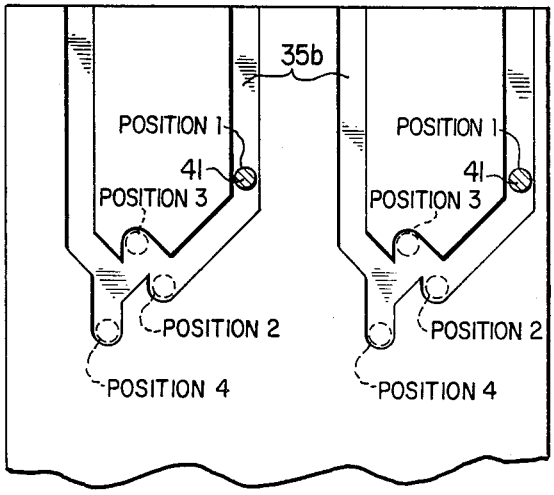
FIG. 5 is a planar development drawing showing the grooves on the reciprocable mandrel and relative positions of the pins in these grooves during operation of the parking mandrel.

To use the parking mandrel 19 in the system shown in FIG. 1, annulus 32 in grease injector section 22 is filled with grease and sealed with plug 38. Housing 39 is disconnected from thread 33*f* and pins 41 in ring 42 are positioned in positioning groove 35*b* for position 1 as shown in FIG. 5 and the housing is reconnected on thread 33*f*. A solid or stranded line is passed through passage 24 in the parking mandrel and connected to the top of tool string 21. The line is smaller than the inside diameter of tubes 27 by only a few thousands of an inch. Next, tool connector housing 53 is disconnected from thread 49*d* and moved downwardly to permit lugs 55 to move outwardly into groove 53*a*. The top of the tool string is inserted into tool connector mandrel 54 and tool connector housing 53 is reconnected to thread 49*d* moving lugs 55 inwardly into a groove around the upper end of the tool string connecting the tool string to mandrel 54 and lock mandrel 19.

Mandrel 19 is now lowered on line 20 into tubing string 12 through connector 15 until lugs 50 land on the internal shoulder 17*a* in landing nipple 17 and seals 47 are in the landing nipple seal bore 17*b*. The weight of mandrel 19 and the connected tool string will compress spring 52 and move groove 35*g* on mandrel 35 downwardly. Lugs 50 are retracted inwardly into groove 35*g* by the landing nipple shoulder, pass through the shoulder and compressed spring 52 extends, moving the lugs downwardly on mandrel 35 out of groove 35*g* under the landing shoulder and onto expander surface 35*h*. As shoulder 49*a* on lug housing 49 will land on and not go through the internal shoulder 17*a* in landing nipple 17, mandrel 19 is now locked in landing nipple 17 and cannot be moved upwardly or downwardly.

While the parking mandrel is being lowered into the tubing, well fluids may flow from outside the mandrel to inside the reciprocable mandrel through openings 39*c* and 35*d*.

The well test tools may be used to determine the well liquid level while being lowered to the landing nipple or after the parking mandrel is locked in the landing nipple.

To disconnect tool string 21 from lock mandrel 19 and lower the tool string deeper into tubing 12, line 20 is pulled moving tool string 21, connector mandrel 54 and reciprocable mandrel 35 upwardly relative to ring 42 while compressing spring 45. At the same time, the upward movement of positioning groove 35*b* on mandrel 35 under ring 42 moves pins 41 from position 1 to position 2 of FIG. 5. Thereafter, when pull on line is released, spring 45 extends moving mandrel 35 downwardly and pins 41 follow mandrel grooves 35*b* to position 3, limiting down travel of mandrel 35 and positioning passage 35*d* above upper seal 46, preventing flow through passages 39*c* and 35*d*. Lugs 55 in connector mandrel 54 are now in alignment with groove 53*a* in connector housing 53 and the tool string is disconnected from mandrel 19. Tools 21 are now free to be lowered to any desired depth in the well tubing below the parking mandrel by lowering the line through passage 24.

When the tools 21 have reached the desired depth for testing the well, pump 14 may be operated to pump fluids upwardly through connector 15 into the tubing to surface. When the pump is operated, pressure in the well tubing increases and acts through inlet passage **25*b* in top connector 25, moving piston 29 downwardly in grease injection section 22. Downward movement of this piston forces grease from annulus 32 through upper tube slot 27*a*, larger bore 33*b*, spacer opening 37*a* around the line in upper and lower tubes 27 to seal the line in the tube and lubricate the line when it is sliding through tubes 27 and passage 24** in the parking mandrel.

After testing the well, pump operation is ceased and the line is raised until the top of tool string 21 is pulled back into tool connector mandrel 54. Increased pull on the line moves reciprocable mandrel 35 upwardly compressing spring 45 and moves pins 41 to position 4 in grooves **35*b*. Lugs 55 have moved inwardly and above groove 53*a* in the tool connector, reconnecting tool string 21 to connector mandrel 54 and mandrel 19. When expander surface 35*h* moves up under the lugs 50, the lugs retract from under the internal shoulder in landing nipple 17 into groove 35*i*, unlocking mandrel 19** from the landing nipple. The line may be raised lifting the connected tool string and parking mandrel back to surface.

If the mandrel cannot be unlocked and pulled from the landing nipple, sufficient pull should be placed on the line to shear pins 48 connecting lug housing 49 to lower housing 39 and move expander surface **35*h* upwardly under the lugs 50 so that the lugs may retract into groove 35*i*, unlocking the mandrel from landing nipple 17. On raising the line further, the top of connector mandrel 54 contacts the lower end of the lug housing 49 lifting mandrel 19** from the landing nipple for return to surface.

What I claim is:

1. A parking mandrel having a through passage for line, said mandrel releasably lockable in a landing nipple having an internal shoulder, comprising:

(a) a cylindrical housing having a landing shoulder thereon;

(b) resilient means on said housing above said landing shoulder for sealing in the landing nipple;

(c) grease supply means within said housing for sealing said parking mandrel around said line;

(d) releasable locking means below said injector means for locking said mandrel in the landing nipple;

(e) connecting means below said locking means for connecting said parking mandrel to a tool string; and (f) operating means including a reciprocable mandrel for operating said connecting means to disconnect and reconnect and said locking means to release.

2. The parking mandrel of claim 1 further including shearable means for unlocking the mandrel.

3. The parking mandrel of claim 1 wherein the grease supply means comprise:

(a) upper and lower tubes around the wireline passage in the housing;

(b) an annulus between said upper tube and the housing;

(c) grease in said annulus;

(d) a flow passage between said annulus and the inside of said upper and lower tubes; and (e) pressure responsive means for injecting grease from said annulus through said flow passage into said upper and lower tubes.

4. The parking mandrels of claim 3 wherein the pressure responsive means comprise:

(a) a piston slidably sealed around the upper tube and in the housing; and (b) an inlet passage in the housing communicating between the housing exterior and the piston.

5. The parking mandrel, of claim 1 wherein the releasable locking means comprise:

(a) openings through the housing wall;

(b) a lug slidably mounted in each opening;

(c) a larger lug expander surface on the mandrel;

(d) a smaller groove on the mandrel; and (e) biasing means biasing the lugs toward the lower end of said openings.

6. The parking mandrel of claim 1 wherein the connecting means comprise:

(a) openings through the reciprocable mandrel wall;

(b) a lug laterally slidable in each opening; and (c) a groove in the housing.

7. The parking mandrel of claim 1 wherein the operating means comprise:

(a) grooves on the reciprocable mandrel;

(b) rotatable means within said housing, coengaged with and rotated by reciprocating the reciprocable mandrel for moving said mandrel upwardly from a lower position wherein the connecting means is in connected position, to a position wherein the connecting means is disconnected, to a position wherein the connecting means is again connected, and to a position releasing the locking means; and (c) resilient means biasing said mandrel toward the lower position.

8. The mandrel of claim 7 wherein the rotatable means comprise:

(a) a ring rotatably mounted in a recess in the housing; and (b) pins protruding into each reciprocable mandrel groove and connected in said ring.

9. The parking mandrel of claim 2 wherein the mandrel housing includes a lower mandrel housing and a lug housing, said lug housing connected below said mandrel housing and the shearable means are pins passing through the lug housing and mandrel housing walls.

10. The parking mandrel of claim 9 further including means for preventing rotation of the reciprocable mandrel in the housing.

11. The parking mandrel of claim 10 wherein the means preventing rotation is a slot on the reciprocable mandrel into which one of the pins protrudes.

12. The parking mandrel of claim 5 wherein the biasing means comprise:

(a) a shoulder in the housing; and (b) a spring around the reciprocable mandrel between the lugs and said shoulder.

13. The parking mandrel of claim 1 further including closable flow passage means for allowing flow from outside the parking mandrel housing to inside the reciprocable mandrel.

14. The parking mandrel of claim 13 wherein the closable flow passage means comprise:

(a) at least one flow passage through the housing wall;

(b) at least one flow passage through the reciprocable mandrel wall; and (c) resilient seals in the housing above and below said housing flow passage sealing around said mandrel above and below said mandrel flow passage.

15. Apparatus for testing a well comprising:

(a) a landing nipple having an internal shoulder therein; and (b) a parking mandrel lowerable on flexible line passing through said mandrel into said landing nipple to land on said shoulder and releasably lock in sealed relationship with said landing nipple, said line connected to a string of test tools and said test tools connected to said parking mandrel, said parking mandrel including means responsive to pulling and lowering the line for disconnecting and reconnecting the tool string to the parking mandrel.

16. The apparatus of claim 15 wherein the parking mandrel includes means for releasing said parking mandrel from the locking position in response to pulling and lowering the line.

17. The apparatus of claim 16 wherein the parking mandrel further includes shearable means for releasing the parking mandrel lock in response to line pull.

18. Apparatus for testing a well comprising:

(a) a landing nipple adapted to be connected in a well tubing string, said nipple having an internal shoulder and a seal bore above said shoulder therein; and (b) a parking mandrel having a flexible line connected to a string of test tools passed therethrough, said mandrel lowerable on the line into said landing nipple to sealingly engage said seal bore and land on and releasably lock under said internal shoulder, said mandrel comprising:

a housing having a landing shoulder thereon for landing on said nipple shoulder, resilient means on said housing sealingly engageable in said landing nipple bore, pressure operable grease supply means within said housing for sealing said parking mandrel around said line, releasable locking means lockable under said nipple shoulder for locking the parking mandrel in the nipple, connecting means for connecting the parking mandrel to the tool string, and operating means responsive to pulling and lowering the line for operating said connecting means to disconnect said tool string from and reconnect said tool string to said mandrel and release said locking means.

* * * * *